United States Patent [19]

Nagel, Jr.

[11] Patent Number: 4,555,038

[45] Date of Patent: Nov. 26, 1985

[54] TAMPER-EVIDENT RESEALABLE CAP

[76] Inventor: James H. Nagel, Jr., 7131 Cambria Cir., Orange, Calif. 92669

[21] Appl. No.: 632,947

[22] Filed: Jul. 20, 1984

[51] Int. Cl.[4] ..... B65D 41/48

[52] U.S. Cl. ..... 215/235; 215/253

[58] Field of Search ..... 215/235, 237, 253, 254, 215/258; 220/269

[56] References Cited

U.S. PATENT DOCUMENTS

| | | | |
|---|---|---|---|
| 3,257,022 | 6/1966 | Robinson | 215/235 |
| 3,266,652 | 8/1966 | Lohrer | 215/235 |
| 3,438,529 | 4/1969 | Lohrer | 215/253 X |
| 3,465,910 | 9/1969 | Richie | 220/270 |
| 3,750,820 | 8/1973 | Labarre | 215/253 |
| 4,361,244 | 11/1982 | Walter | 215/253 |
| 4,431,110 | 2/1984 | Roth | 215/213 |

FOREIGN PATENT DOCUMENTS

| | | | |
|---|---|---|---|
| 1284169 | 1/1962 | France | 215/253 |
| 1265008 | 3/1972 | United Kingdom | 215/253 |

*Primary Examiner*—Donald F. Norton

*Attorney, Agent, or Firm*—King, Liles & Schickli

[57] ABSTRACT

A resealable container cap includes a skirt portion that is permanently attached to the container about a container opening. A plug portion, hinged to and received within the skirt portion, engages the container wall to seal the opening. A score line initially connects and provides a line of weakening between the skirt and plug portions. Initial removal of the plug portion from the skirt portion to open the container tears the connection along the score line leaving a clearly visible indication that the container has been previously opened.

8 Claims, 6 Drawing Figures

TAMPER-EVIDENT RESEALABLE CAP

TECHNICAL FIELD

The invention relates generally to container closures and more specifically to a tamper-evident resealable cap for a product container that indicates whether the container has been previously opened.

BACKGROUND OF THE INVENTION

There has been a heightened demand in recent years for tamper-evident product containers that readily indicate when a product container has been previously opened. Such tamper-evident containers have proven highly effective in detecting and discouraging pilferage of products in the containers and in alerting a user of possible product contamination.

One common prior art technique for providing tamper-evident containers is to use a supplementary closing element designed for destruction upon the initial removal of a primary closure member. For example, it is known to partially encapsulate the primary closure member with a heat shrinkable plastic that prohibits removal of the primary closure member. In order to remove the primary closure element, it is then necessary to tear or otherwise destroy the heat shrinkable plastic. Another type of supplementary closing element involves a semi-rigid plastic covering secured to the periphery of the container opening and spanning the entire opening. This last mentioned supplementary closing element is disposed beneath the primary closure member and must be removed before initial access to the container contents is possible. Unfortunately, it is possible to completely remove each of the above described supplementary closing elements from the container after accessing the product contained therein. When these supplementary closing elements are completely removed, prior opening of or tampering with the container contents is not readily apparent, particularly to an unsuspecting consumer.

Still another technique for providing tamper-evident containers is disclosed in U.S. Pat. No. 4,431,110 to Roth and U.S. Pat. No. 4,361,244 to Walter. In these prior art patents, a plastic sleeve supports a hinged closure member having a lever portion and a small plug portion to close the container opening. The lever portion of the closure member is initially connected to the cap by a frangible member, designed to be broken during the initial activation of the lever portion to open the container. However, in practice the frangible interconnection between the lever and plug portions may remain intact, without clearly indicating tampering, since the two portions are mechanically attached rather than integrally formed and thus can separate without leaving a tell-tale break. Further, the frangible member of this prior art design is not located at the container opening and thus not prominently visible and may not be noticed, even when broken, by an unskilled or unsuspecting user. Finally, this type of prior art cap is not suitable for a non-liquid product requiring a wide mouth bottle or jar, such as vitamins and health food supplements.

SUMMARY OF THE INVENTION

Accordingly, it is a primary object of the invention to provide a tamper-evident resealable closing assembly for a container that is prominently visible to even an unskilled or unsuspecting observer.

Another object of the invention is to provide an improved tamper-evident resealable cap for a container that has integral but rupturable parts to give a visual indication of prior opening.

It is another object of the invention to provide an easy to open reclosable cap for a wide-mouth jar or the like having a means that is for indicating a prior entry into the container adjacent the mouth.

Additional objects, advantages, and other novel features of the invention will be set forth in part in the description that follows and in part will become apparent to those skilled in the art upon examination of the following or may be learned with the practice of the invention. The objects and advantages of the invention may be realized and attained by means of the instrumentalities and combinations particularly pointed out in the appended claims.

To achieve the foregoing and other objects, and in accordance with the purposes of the present invention as described herein, an improved container cap is provided for readily indicating when a container has been previously opened. The cap includes a skirt portion which is permanently attached to a container about an opening. A plug portion of the cap is integrally formed with and disposed within the skirt portion for selectively engaging a wall of the container to selectively close the opening. The skirt and plug portions are separated by a score line which provides a line of weakening therebetween. Initial removal of the plug portion of the cap from the skirt portion to unseal the container opening irrevocably disjoins the skirt and plug portions along the score line to form means for clearly indicating that the container has been previously opened once the opening is resealed by repositioning the plug portion within the container opening.

In one aspect of the invention, the interface between the skirt and plug portions is annular and the score line extends annularly about the periphery of the plug portion.

In another aspect of the invention, the means for indicating that the container has been previously opened includes a void separating the skirt and plug portions.

An alternative means for indicating that the container has been previously opened includes disconnected jagged edges of the broken score line between the skirt and plug portions.

According to another object of the invention, a hinge is provided between the skirt and plug portions for pivotally removing the plug portion from the skirt portion to unseal the container opening. The plug portion is also pivotally moved for repositioning in the skirt portion to sealingly close the container opening.

In accordance with another aspect of the invention, the skirt and plug portions are formed of molded plastic, and the hinge is integrally molded to both the skirt and plug portions.

Another aspect of the invention involves the use of a lift tab on the plug portion of the cap for facilitating removal of the plug portion from the skirt portion.

In a more specific aspect of the invention, the lift tab extends radially outwardly from the periphery of the plug portion. The lift tab extends through a notch in the skirt portion when the plug portion is positioned to close the container opening.

According to a further specific aspect of the invention, the skirt and plug portions are separated by two score lines joined by a tear strip disposed therebetween.

The tear strip is removable to sever the score lines and to disjoin the skirt and plug portions.

The lift tab is diametrically opposite the hinge about the periphery of the plug between skirt and plug portions.

In another aspect of the invention, the skirt and plug portions are formed of molded plastic, and the tear strip is integrally molded to both the skirt and plug portions.

A more specific aspect of the invention includes two oppositely disposed arcuate tear strips extending between the lift tab and hinge on opposite peripheral sides of the plug member. Each of the tear strips is disposed between a pair of score lines, which score lines are severed by removal of the tear strips.

According to another aspect of the invention, each of the tear strips includes an end portion extending outwardly from the container cap for facilitating manual grasping and removal of the tear strips. The end portions overlie the lift tab. For added convenience, the end portions can be connected forming a loop for grasping and removal of the strips together in one motion.

In another aspect of the invention, the cap is formed of molded plastic.

Still other objects of the present invention will become readily apparent to those skilled in this art from the following description wherein there is shown and described a preferred embodiment of this invention, simply by way of illustration of one of the best modes contemplated for carrying out the invention. As it will be realized, the invention is capable of other different embodiments, and its several details are capable of modifications in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrate several aspects of the present invention, and together with the description serve to explain the principles of the invention. In the drawings.

Reference will now be made in detail to the present preferred embodiment of the invention, an example of which is illustrated in the accompanying drawings.

DETAILED DESCRIPTION OF THE PREFERRED EMBODIMENT

Figure 1:
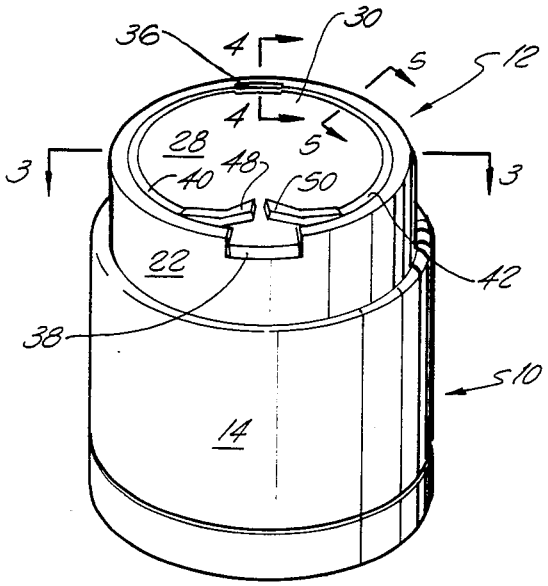
FIG. 1 is a perspective view of a container having a resealable cap constructed in accordance with the invention.

Reference is now made to FIG. 1 showing a container 10 having a resealable cap 12 constructed in accordance with the invention. The container 10 has a substantially planar bottom (not shown) and a generally cylindrical sidewall 14 leading to a neck 16 (see FIGS. 2 and 3) of reduced diameter at the top of sidewall 14. The neck 16 defines the sole opening 18 in the container 10.

The resealable cap 12 is fitted over the neck 16 to selectively seal the container opening 18. The cap 12 includes a cylindrical skirt portion 22 permanently fixed about the outer periphery of the neck 16. This skirt portion 22 is maintained in a permanently fixed position about the neck 16 by a rib 24 (FIG. 3) extending radially outwardly from the neck 16, which rib 24 is received by a correspondingly shaped groove 26 on the interior sidewall of the skirt portion 22.

A plug portion 28 of the cap 12 to directly engage and close the opening 18 of the container 10 is formed integrally with the skirt portion 22. The illustrated plug portion includes a substantially planar top closure 30 spanning the opening 18 defined by the container neck 16. An annular seat 32 depends downwardly from the top closure 30 to engage the interior surface defined by the opening. In the preferred embodiment, the annular seat 32 has a lead-in taper 34 to guide and center the plug portion 28 as the plug portion 28 is seated against the neck 16 during closure.

The plug portion 28 is permanently interconnected to the skirt portion 22 by an integrally molded hinge 36. The hinge 36, as illustrated in FIGS. 1 and 4, is a thin web of material extending between the top closure 30 of plug portion 28 and the top edge of the skirt portion 22. The hinge 36 flexes about an axis substantially parallel with the tangent to the closure 30 to allow pivotal opening movement between the skirt and plug portions 22,28. Such pivotal movement permits the plug portion 28 to move between open (FIG. 2) and closed positions (FIGS. 1, 3, 4 and 5) to provide selective access to the contents of container 10.

A lift tab 38 (FIGS. 1 and 2) extends radially outwardly from the top closure 30 of plug portion 28 at a location approximately 180 degrees about the periphery of plug portion 28 with respect to the hinge 36. This diametrically opposite position of the lift tab 38 with respect to the hinge 36 enables a user to manually lift the plug portion with respect to the skirt portion 22 about the axis of the hinge 36 to open and close the cap 12.

In a preferred form of the invention, the resealable cap 12 is a molded one piece unit. As initially formed, the skirt and plug portions 22,28 of the cap 12 are integrally formed in the closed position of FIG. 1. Relative opening movement between the skirt and plug portions 22,28 is prevented by a pair of opposed arcuate tear strips 40,42. The illustrated tear strip 40 extends about one peripheral side of the plug portion 28 from the lift tab 38 to the hinge 36 while the tear strip 42 is shown as extending about the opposite peripheral plug side between the lift tab 38 and hinge 36.

Figure 5:
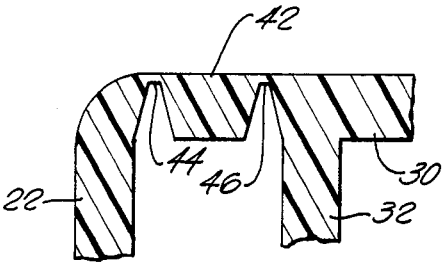
FIG. 5 is a fragmentary cross-sectional view of the container cap of FIGS. 1–4 taken along line FIG. 5 and FIG. 1 showing one of two tear strips interconnecting the skirt and plug portions of the cap.

Referring now to FIG. 5, the tear strip 42 and the annular interface connections between skirt and plug portions 22 and 28 is shown in greater detail. It is seen that the tear strip 42 is initially interconnected to both the skirt and plug portion 22,28 by sections of the molded plastic material weakened by a reduction in material thickness. These areas of material thickness reduction define score lines about which the tear strip 42 may be readily severed from the cap 12, score line 44 being disposed between the tear strip 40 and the skirt portion 22, and score line 46 being disposed between the tear strip 40 and the plug portion 28. Tear strip 40, as shown in FIG. 3, is similarly separated from the skirt and plug portion 22,28 by score lines 51,52.

Figure 3:
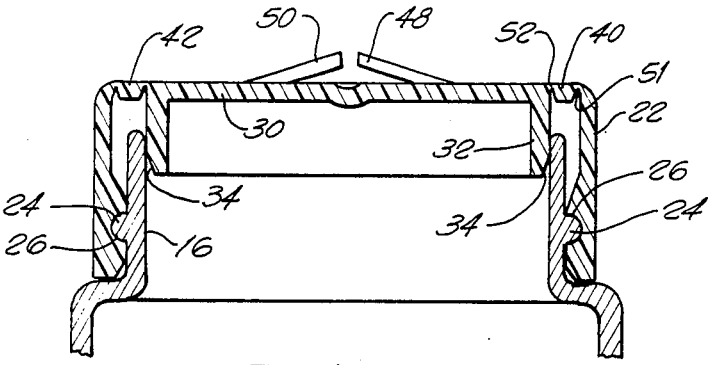
FIG. 3 is a fragmentary cross-sectional view of the container and cap of FIGS. 1 and 2, taken along line 3—3 of FIG. 1.
Figure 4:
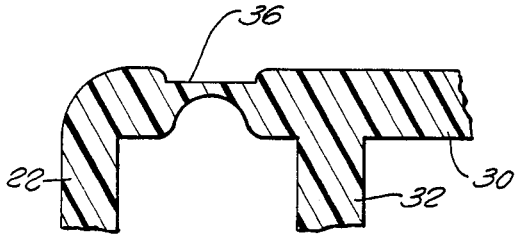
FIG. 4 is an enlarged fragmentary cross-sectional view of the container cap of FIGS. 1–3 taken along line 4—4 in FIG. 1 and showing a hinge pivotally securing the skirt and plug portions of the cap.

Further, as illustrated in FIGS. 1 and 3, each of the tear strips 40,42 has an upwardly extending free end portion, 48 and 50 respectively, for facilitating manual gripping and removal of the tear strips 40,42. The tear strips 40,42 initially join the skirt and plug portions 22,28 along substantially the entire annular interface between these two portions to prevent relative movement therebetween. In order to open the container 10, it is necessary to first disjoin these two cap portions 22,28. This is easily accomplished in the preferred embodiment by manually grasping and pulling the free ends 48 and 50 of the tear strips 40,42. Pulling upon the tear strips 40,42 severs the interconnection between the skirt and plug portions 22,28 by severing the cap material along weakened score lines 44,46 and 51,52. After the tear strips 40,42 are removed in this manner, they are thereafter discarded.

Figure 2:
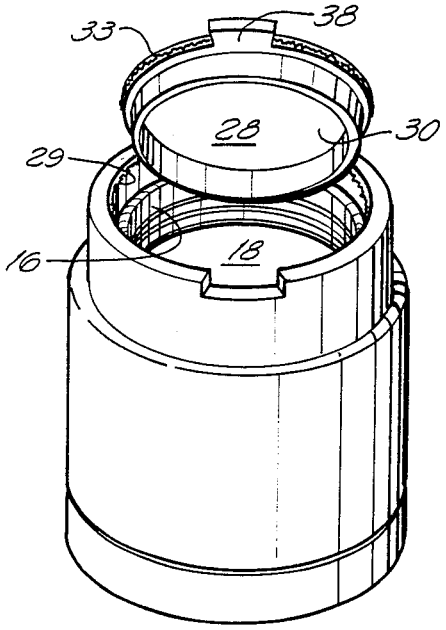
FIG. 2 is a perspective view of the container and resealable cap of FIG. 1 depicting the cap in an open position to provide access to the interior of the container.

Once the tear strips 40,42 are removed, the container 10 may be opened by the application of pressure against the underside of the lift tab 38. This pressure unseals the annular seat 32 from the container neck 16 and pivots the plug portion 28 about the hinge 36, as shown in FIG. 2, to provide access to the container opening 18.

Significantly, the removal of tear strips 40 and 42 results in several readily visually apparent indicia. If the tear strips are completely removed, a substantial void (initially occupied by tear strips 40,42) separates the skirt and plug portions 22,28. Further, as indicated in FIG. 2, the peripheral edges 29,33 of both the skirt and plug portions 22,28 are jagged. Moreover, it is necessary to separate the tear strips 40,42 along a substantial peripheral interface of the skirt and plug portions to unseat annular seat 32 from the container neck 16. Any such partial removal of the tear strips 40,42 would be even more readily apparent. Hence, in order to gain access to the container through opening 18, it is necessary to irreparably alter the visual appearance of the resealable cap 12.

Figure 6:
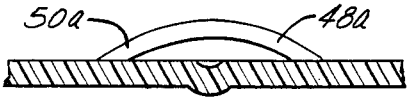
FIG. 6 is a partial fragmentary cross-sectional view of an alternative embodiment.

In an alternative embodiment, a loop may be formed by connecting end portions **48*a*,50*a* of the tear strips 40,42 (see FIG. 6). The loop allows easy grasping by a single finger and removal of the strips in one motion back toward the hinge 36**.

In summary, numerous benefits have been described which result from employing the concepts of the invention. The invention provides a resealable cap that is easily opened but which provides a readily apparent visual indicia upon initial opening. Thus, any tampering with a sealed container constructed in accordance with this invention is readily evident, even by an unsuspecting consumer. The ability to readily detect tampering discourages unauthorized persons from tampering with the container contents and secures such contents against both pilferage and contamination.

The foregoing description of a preferred embodiment of the invention has been presented for purposes of illustration and description. It is not intended to be exhaustive or to limit the invention to the precise form disclosed. Obvious modifications or variations are possible in light of the above teachings. For example, it is possible to connect the skirt and plug portions of the invention with a separate frangible material to define score lines that are easily and irreparably severed upon initial opening of the container cap. Additionally, the skirt and plug portions of the invention may assume any number of geometric configurations. The embodiment was chosen and described in order to best illustrate the principles of the invention and its practical application to thereby enable one of ordinary skill in the art to best utilize the invention in various embodiments and with various modifications as are suited to the particular use contemplated. It is contemplated that the scope of the invention be defined by the claims appended hereto.

I claim:

1. A resealable container cap for readily indicating when a container has been previously opened, comprising:

a skirt portion adapted for permanent attachment to a container about an opening in the container;

a plug portion integrally formed with and disposed within the skirt portion for selectively engaging a wall of the container to sealingly close the container opening;

two score lines joined by a tear strip disposed therebetween and separating said skirt and plug portions;

wherein initial removal of the plug portion from the skirt portion to unseal the container opening requires removal of the tear strip that irrevocably disjoins the skirt and plug portions along the score lines to form means for indicating that the container has been previously opened upon repositioning the plug portion into the skirt portion to sealingly close the container opening.

2. A resealable container cap as recited in claim 1 wherein the skirt and plug portions are formed of molded plastic, and the tear strip is integrally molded to both the skirt and plug portions.

3. a resealable container cap for readily indicating when a container has been previously opened, comprising:

a skirt portion adapted for permanent attachment to a container about an opening in the container;

a plug portion integrally formed with and disposed within the skirt portion for selectively engaging a wall of the container to sealingly close the container opening, said plug portion including a lift tab and a hinge permanently connecting said plug and skirt portions together;

a pair of score lines and two oppositely disposed arcuate tear strips, said tear strips extending between said lift tab and said hinge on opposite peripheral sides of the plug portion, each of said tear strips being disposed between said pair of score lines that are severed on removal of the tear strips;

wherein initial removal of the plug portion from the skirt portion to unseal the container opening irrevocably disjoins the skirt and plug portions along the score lines to form means for indicating that the container has been previously opened upon repositioning the plug portion into the skirt portion to sealingly close the container opening.

4. A resealable container cap as recited in claim 3 wherein the lift tab is diametrically opposite the hinge between the skirt and plug portions.

5. A resealable container cap as recited in claim 4 wherein two oppositely disposed arcuate tear strips extend between the lift tab and the hinge on opposite peripheral sides of the plug portion, each of tear strips being disposed between a pair of score lines that are severed by removal of the tear strips.

6. A resealable container cap as recited in claim 3 wherein each of the tear strips includes an end portion extending outwardly from the container cap for facilitating manual grasping and removal of the tear strips.

7. A resealable container cap as recited in claim 6 wherein the tear strips are connected to form a loop for easy removal in one motion.

8. A resealable container cap as recited in claim 3 wherein the cap is formed of molded plastic.

* * * *

UNITED STATES PATENT OFFICE
CERTIFICATE OF CORRECTION

Patent No. 4,555,038 Dated November 26, 1985

Inventor(s) JAMES H. NAGEL, JR.

It is certified that error appears in the above-identified patent and that said Letters Patent are hereby corrected as shown below:

Claim 5 should be deleted. Claims 6, 7 and 8 should be renumbered as claims 5, 6 and 7, respectively. In column 8, line 3, claim 7, the numeral "6" should read --5-- to conform to the renumbering of claims. In column 6, line 39, claim 3, the word "a" should read --A--.

Signed and Sealed this

*Twenty-seventh* Day of *May 1986*

[SEAL]

*Attest:*

DONALD J. QUIGG

*Attesting Officer* *Commissioner of Patents and Trademarks*